US010040160B2

(12) United States Patent
Zandonella Necca et al.

(10) Patent No.: US 10,040,160 B2
(45) Date of Patent: Aug. 7, 2018

(54) GRINDING WHEEL, PARTICULARLY FOR GRINDING PROCESSING OPERATIONS CARRIED OUT ON SHEETS OF GLASS, CERAMIC MATERIAL OR SIMILAR MATERIALS

(71) Applicant: ADI S.P.A., Thiene (VI) (IT)

(72) Inventors: Dino Zandonella Necca, Vicenza (IT); Ferruccio Gonzo, Isola Vicentina (IT); Walter Saccardo, Thiene (IT)

(73) Assignee: ADI S.R.L., Thiene (VI) (IT)

( * ) Notice: Subject to any disclaimer, the term of this patent is extended or adjusted under 35 U.S.C. 154(b) by 81 days.

(21) Appl. No.: 15/029,827

(22) PCT Filed: Oct. 14, 2014

(86) PCT No.: PCT/EP2014/072045
§ 371 (c)(1),
(2) Date: Apr. 15, 2016

(87) PCT Pub. No.: WO2015/055671
PCT Pub. Date: Apr. 23, 2015

(65) Prior Publication Data

US 2016/0297049 A1 Oct. 13, 2016

(30) Foreign Application Priority Data

Oct. 17, 2013 (IT) ..... PD2013A0286

(51) Int. Cl.
*B24D 5/10* (2006.01)
*B24D 5/16* (2006.01)
(Continued)

(52) U.S. Cl.
CPC ..... *B24B 9/10* (2013.01); *B24D 5/066* (2013.01); *B24D 5/10* (2013.01); *B24D 5/16* (2013.01);
(Continued)

(58) Field of Classification Search
CPC .... B24B 9/00; B24B 9/08; B24B 9/10; B24D 5/066; B24D 5/10; B24D 5/16; B24D 13/02; B24D 13/18
(Continued)

(56) References Cited

U.S. PATENT DOCUMENTS 2,268,599 A * 1/1942 Kinney ..... B24D 5/06 451/541
2,735,247 A * 2/1956 Holzhausen et al. ..... B24B 3/54 451/342
(Continued)

FOREIGN PATENT DOCUMENTS

DE 10125990 A1 12/2002
EP 1533078 A1 5/2005
(Continued)

*Primary Examiner* — Eileen Morgan
(74) *Attorney, Agent, or Firm* — Volpe and Koenig, P.C.

(57) ABSTRACT

There is described a grinding wheel (1), particularly for grinding operations carried out on sheets of glass (2), ceramic material or similar materials, comprising a disc-shaped support with abrasive material arranged on the circumferential profile of the support, and an opposing central hole (3) for attachment to a drive shaft (4) of the grinding wheel. The disc-shaped support comprises a pair of opposed disc-shaped grinding wheel bodies (5, 6) coupled in a facing position so as to define together the abrasive grinding surface (5*c*, 6*c*) along the circumferential profile, and each of the disc-shaped bodies (5, 6) has a predetermined resilience such that the disc-shaped bodies (5, 6) can be flexed away from each other in the zone of contact with the component being ground, for the purpose of consequently applying pressure to the component in the grinding operation.

8 Claims, 3 Drawing Sheets

(51) Int. Cl.

| | |
|---|---|
| ***B24D 13/18*** | (2006.01) |
| ***B24D 13/20*** | (2006.01) |
| ***B24B 9/10*** | (2006.01) |
| ***B24D 5/06*** | (2006.01) |
| ***B24D 13/02*** | (2006.01) |

(52) U.S. Cl.
CPC ..... *B24D 13/02* (2013.01); *B24D 13/18* (2013.01); *B24D 13/20* (2013.01)

(58) Field of Classification Search
USPC ..... 451/178
See application file for complete search history.

(56) References Cited

U.S. PATENT DOCUMENTS 5,371,977 A * 12/1994 Liner ..... B24B 3/365 451/262
5,609,518 A * 3/1997 Lucchesi ..... B24B 49/00 144/134.1
6,793,564 B1 * 9/2004 Lupi ..... B24B 9/06 451/178
7,094,136 B2 * 8/2006 Nomoto ..... B24B 9/06 451/178
2005/0277377 A1 * 12/2005 Nomoto ..... B24B 9/06 451/541
2007/0082592 A1 * 4/2007 Junker ..... B24D 5/066 451/541
2013/0225055 A1 8/2013 Ng et al.
2013/0295824 A1 * 11/2013 Hasegawa ..... B24D 15/082 451/349
2015/0343542 A1 * 12/2015 Dunda ..... B23D 63/123 451/543

FOREIGN PATENT DOCUMENTS

EP 1607177 A1 12/2005
LU 88720 A1 10/1996

* cited by examiner

GRINDING WHEEL, PARTICULARLY FOR GRINDING PROCESSING OPERATIONS CARRIED OUT ON SHEETS OF GLASS, CERAMIC MATERIAL OR SIMILAR MATERIALS

TECHNICAL FIELD

The present invention relates to a grinding wheel, particularly intended for grinding processing operations for sheets of glass, ceramic material or other similar materials, having the features set out in the preamble of main claim 1.

TECHNOLOGICAL BACKGROUND

The invention involves particularly though not exclusively the specific technical sector of grinding processing for sheets of glass, in which the corners of the sheets are beveled by means of grinding.

In that field, as well as on the basis of safety standards, the glass sheets which often have substantial dimensions must have beveled corners in order to make their handling safe as well as for aesthetic matters and matters involving conserving the material integrity, because jagged edges increase the possibility of propagation of cracks and fractures.

To that end, there have been developed types of grinding machines which are specifically dedicated to carrying out that operation.

In accordance with a first known type, there are provided diamond-coated grinding wheels which travel along the peripheral edge of the sheet in order to bevel the corners thereof. A second known type instead provides for the use of intersecting abrasive or diamond-coated belts which are capable of carrying out the beveling.

The machines with grinding wheels typically have a vertical extent and comprise grinding wheel systems which are directed along the two main Cartesian axes, with a vertical and horizontal orientation, respectively.

STATEMENT OF INVENTION

Since the glass sheets are not always cut at 90° along the corners, the main problem which is encountered in this type of machine is to generate homogeneous beveling actions over the entire extent of the edge of the sheet. In an at least partial solution to that problem, there has been proposed in the prior art a grinding wheel system which is configured so as to place the diamond-coated grinding wheels under constant pressure against the component to be ground. In this manner, the beveling actions are homogeneous even in the presence of real travel actions of the component to be processed which are different from the theoretical ones defined in the machine.

In accordance with other solutions, the presence of variable beveling actions is accepted because the operating system of the machine is independent of the cutting of the glass. The invention involves this particular type of grinding machines in order to overcome the technical problem set out above.

The problem is solved by the invention by means of a grinding wheel of the type set out above, constructed in accordance with the appended claims.

BRIEF DESCRIPTION OF THE DRAWINGS

The features and advantages of the invention will be better appreciated from the following detailed description of a preferred embodiment which is illustrated by way of non-limiting example with reference to the appended drawings, in which.

PREFERRED EMBODIMENTS OF THE INVENTION

With reference to the cited Figures, there is generally designated 1 a grinding wheel which is particularly configured for grinding processing operations for sheets of glass, ceramic material or similar materials, and which is constructed according to the present invention.

Figure 2:
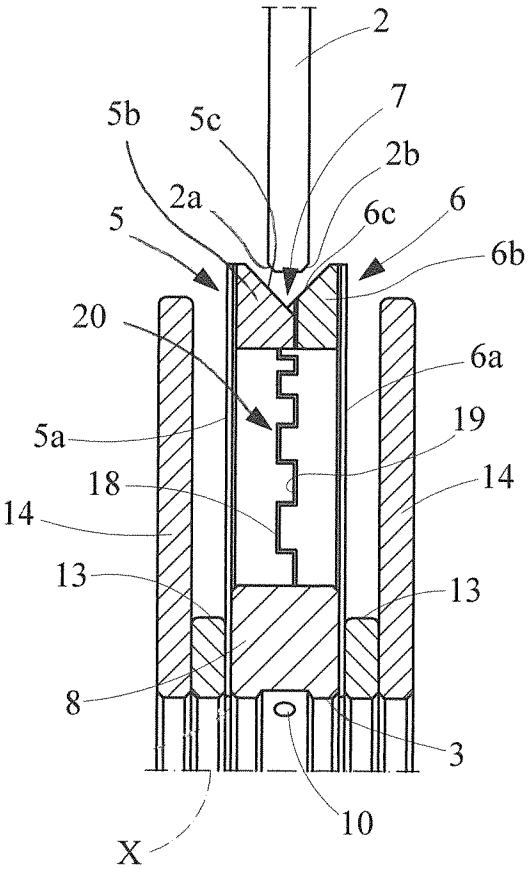
FIG. 2 is a partially sectioned axial view of the grinding wheel of FIG. 1.
Figure 1:
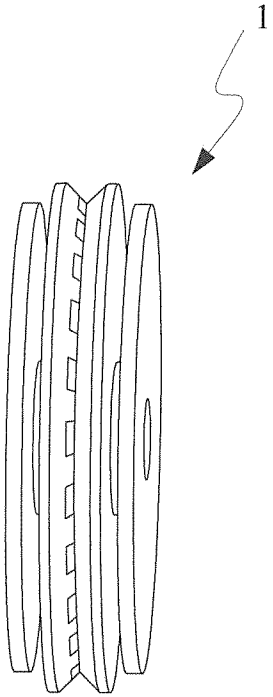
FIG. 1 is a perspective view of a grinding wheel constructed according to the invention.
Figure 4:
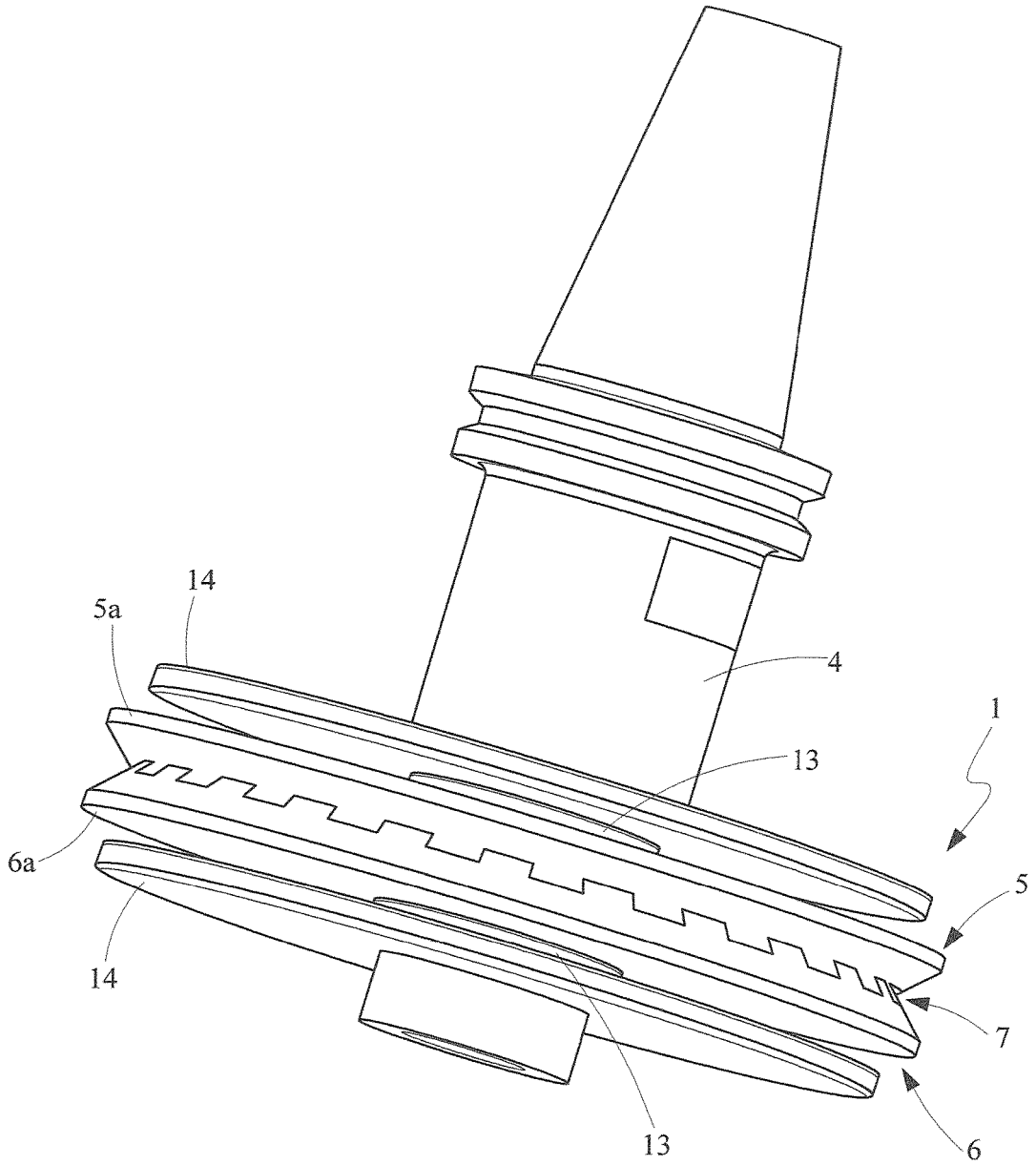
FIG. 4 is a perspective view of the assembly of the grinding wheel of the preceding Figures in a state mounted on a drive shaft.

The grinding wheel 1 is particularly suitable for the operation of beveling the corners of the edge of the sheet, which operation is necessary following cutting of the sheet in order to make the sheet able to be handled in safe conditions. The beveling of the sheet corners further serves to remove from the cutting profile any surface irregularities of the edge which are brought about during the operation of cutting the sheet and which can lead to the generation of fracture cracks in the sheet during the subsequent steps (for example, tempering, assembly, etc.). FIG. 2 partially shows a sheet of the above-mentioned type which is designated 2 and which is intended to be subjected to operations for beveling the opposing corners 2*a*, 2*b* thereof, by means of a grinding processing operation with the grinding wheel of the invention.

The grinding wheel is of the type comprising a disc-shaped support with abrasive material arranged on the circumferential profile of the support and a central hole 3 for attachment to a drive shaft 4 of the grinding wheel. The disc-shaped support is axially symmetrical with respect to a main axis X, about which the grinding wheel is capable of being moved in rotation by the drive shaft 4 during the processing steps.

According to a main feature of the invention, the disc-shaped support of the grinding wheel comprises a pair of disc-shaped bodies 5, 6 which are coupled in a mutually facing position, as clearly shown in FIG. 2, and the abrasive portions of which are coupled in a mutually facing position, so as to define together the entire abrasive grinding surface extending along the outermost circumferential profile of the disc-shaped bodies.

More specifically, each disc-shaped body 5, 6 constitutes the base or resilient core, which is advantageously in the form of a plate of spring steel or another low-hysteresis material. The abrasive material being arranged in the region of the outer circumferential profile of the disc-shaped body, and extending from one of the facing faces of the corresponding plate. In a preferred form, the abrasive material in each body 5, 6 is constructed in the form of a respective annular element 5*b*, 6*b* which is applied to the corresponding plate of the respective disc-shaped body, there being defined on each element an abrasive annular surface which is designated 5*c*, 6*c*, respectively.

The plates of the disc-shaped bodies 5, 6 are provided to be mounted coaxially with the X axis on the shaft 4, with the respective abrasive surfaces 5*c*, 6*c* facing each other, in order to define together a groove, which is generally designated 7, of abrasive material which extends circumferentially along the outer profile of the disc-shaped bodies, inside which groove the contact with the opposing corners 2*a*, 2*b* of the sheet 2 being processed is brought about.

The groove 7 preferably has a V-like axial cross-section with concavity which is directed towards the sheet which is intended to be subjected to grinding, each side of the V-like section being capable of contact with a respective corner 2*a*, 2*b* of the edge of the sheet.

In order to connect the disc-shaped bodies 5, 6, there is provided a first spacer 8 which is in the form of a cylindrical sleeve and which is capable of being mounted coaxially on the drive shaft 4 in a position interposed between the disc-shaped bodies 5, 6, in such a manner that the plates of the bodies are in abutment against the respective, opposing axial ends of the spacer 8. The spacer is further provided with through-passages 10 which extend radially through the thickness of the cylindrical surface thereof and which constitute passages for directly conveying a cooling and/or lubricating liquid onto the surfaces 5*c*, 6*c* of abrasive material of the grinding wheel.

An end of the passages 10 is in fluid communication with an annular chamber 11 which in turn communicates with a feeding passage 12 which is formed inside the shaft 4, while the opposite end of the passages 10 is open in the annular cavity which is delimited by the opposing plates of the bodies 5, 6 in such a manner that the liquid supplied into that cavity can reach by centrifugal action (connected with the rotation of the shaft 4) the contact zone between the abrasive surfaces and the sheet being processed.

A pair of second spacers both designated 13 are provided in ring-like manner to be mounted coaxially on the drive shaft 4 on the opposite side to the first spacer 8, with respect to the corresponding disc-shaped body 5, 6, in a configuration in which each body 5, 6 is interposed between the first spacer 8 and the corresponding particular second spacer 13.

Figure 5:
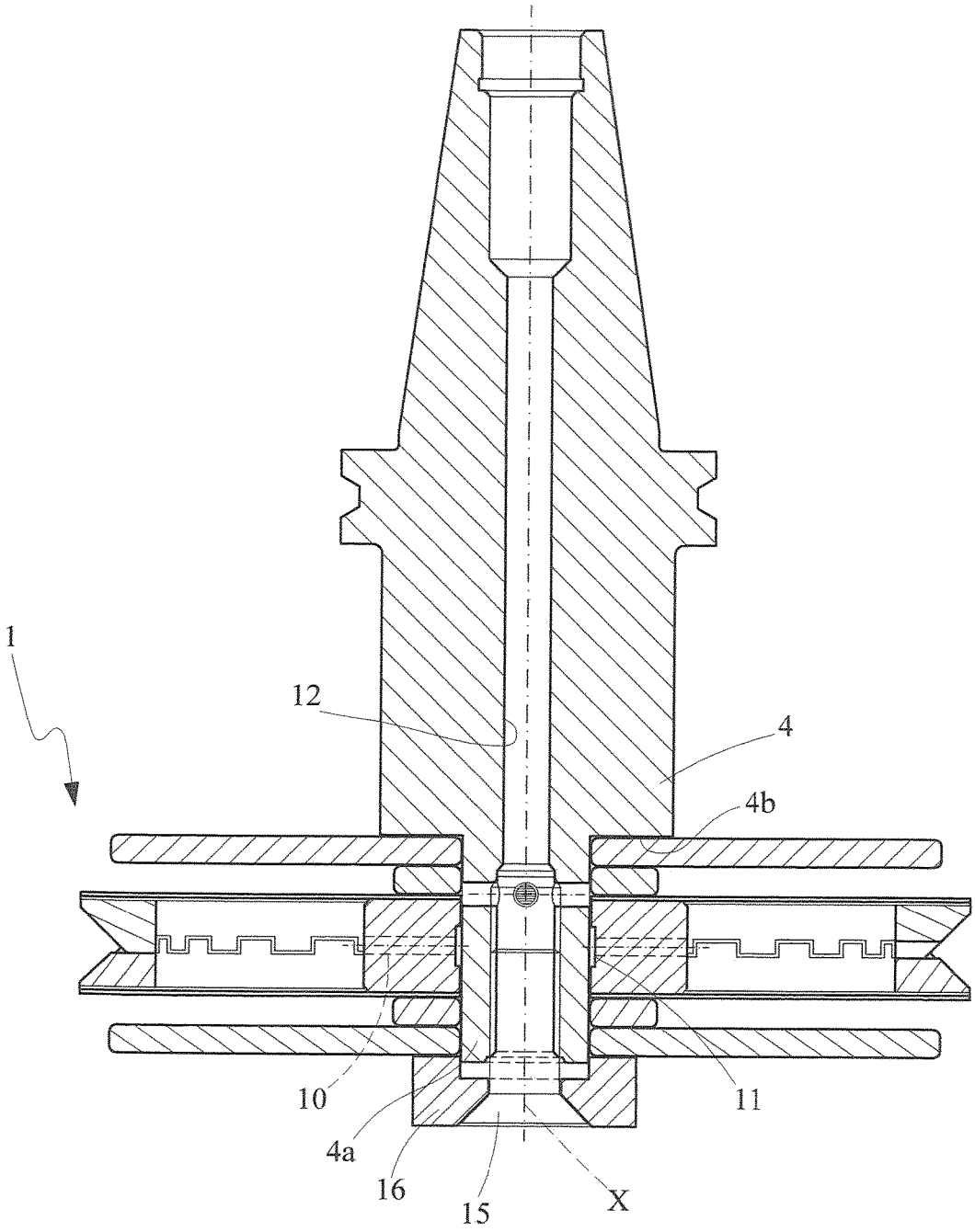
FIG. 5 is an axially sectioned view of the assembly of FIG. 4.

A pair of limiting flanges whose function will be described in detail below and which are both designated 14 are capable of being coaxially mounted on the shaft 4, each of which is provided in a position abutting the respective second spacer 13, as clearly illustrated in FIG. 5. That FIG. 5 clearly shows that the disc-shaped bodies 5, 6, the first spacer 8, the second spacers 13 and the pair of outer flanges 14 are clamped together in the form of an assembly on a shank 4*a* of the shaft 4 by way of a screw type means 15 which blocks the assembly of elements between an abutment 4*b* of the shaft and an outer closure flange 16. The opposite end of the drive shaft 4 relative to the one involved in the assembly closure system of the grinding wheel is further formed in a cone-like manner for fixing the grinding wheel to a CNC machine.

In each disc-shaped body 5, 6, there is further provision for each annular abrasive element to have circumferentially, in the region of the free end thereof, a regular sequence of projections 18 alternating with recesses 19, which define a front toothed profile 20. The toothed profiles 20 of the bodies 5, 6 are configured so as to be capable of meshing with each other by relative engagement, with limited connection play, of the projections 18 in the recesses 19 of one and other disc-shaped body 5, 6. In other words, there is provided relative engagement with reduced axial connection play between the pair of front toothed rings which are defined by the toothed profiles which are provided on the disc-shaped bodies 5, 6 in the region of the abrasive surfaces 5*c*, 6*c*, respectively.

Figure 3:
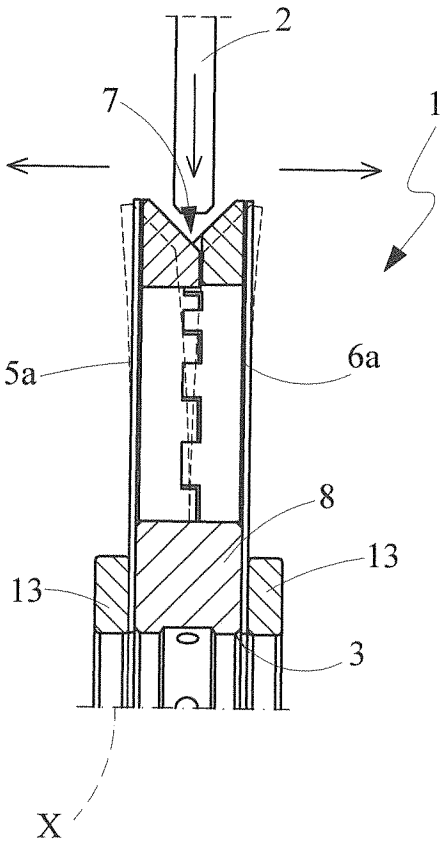
FIG. 3 is a view corresponding to that of FIG. 2 with the grinding wheel illustrated in a different operating condition.

The operating function of the grinding wheel is described in detail below with specific reference to FIGS. 2 and 3.

The sheet 2 intended to be subjected to grinding is arranged perpendicularly relative to the rotation axis X of the grinding wheel. The grinding wheel is positioned with the sides of the groove 7 in contact with the corners 2*a*, 2*b* of the sheet, with an action of light urging into the relative contact.

As a result of the resilience of the plates which form the disc-shaped bodies 5, 6 of the grinding wheel, they are urged to flex resiliently outwards (FIG. 3, portion in broken lines) with the result that they apply a pressure (as a result of the urging in terms of resilient return generated in the plates) against the sheet being processed. That resilient behaviour allows the possible different positioning actions of the sheet (connected with the real travel which does not exactly correspond to the theoretical travel) to be made up for, at any rate ensuring that the corners 2*a*, 2*b* are beveled over the entire extent thereof at the edges of the sheet.

It should be noted that the rigidity of the resilient structure defined by the plate of the disc-shaped body is determined, to a main extent, by the thickness of the plate of each disc-shaped body 5, 6 (if comprising spring steel with thicknesses which typically have values between 0.3 mm and 1 mm) and the dimension of the second spacer 13 (the greater the diameter of the spacer, the more rigid the structure of the plate in the disc-shaped body becomes).

In relation to the flexion of the plates of the disc-shaped bodies which moves them away from each other, the outer flanges 14 act as limiting means for the maximum deformation. The flanges actually have such dimensions in diameter as to interfere with the corresponding plates of the bodies 5, 6 during their flexion movement. The maximum resilient deformation brought about is determined by the thickness of the second spacers 13.

As a result of the provision of the front toothed profiles 20 in mutual engagement, the disc-shaped bodies 5, 6 bring about a type of nesting system which allows a portion of the abrasive surface always to be maintained, even in the case of an increase of the groove 7 as a result of a greater degree of introduction of the sheet, inside the groove itself. In that manner, the possibility of carrying out the beveling at the corners of the sheet is always ensured.

The invention thereby solves the problem set out and achieves the advantages set out with respect to the known solutions.

The invention claimed is:

1. A grinding wheel, for grinding operations carried out on sheets of glass, ceramic material or similar materials, comprising a disc-shaped support with abrasive material arranged on a circumferential profile of the support, and an opposing central hole (3) for attachment to a drive shaft of the grinding wheel, wherein the disc-shaped support comprises a pair of opposed disc-shaped grinding wheel bodies (5, 6) coupled in a facing position so as to define together an abrasive grinding surface along the circumferential profile, and each of the disc-shaped bodies (5, 6) has a predetermined resilience such that the disc-shaped bodies can be flexed away from each other in a zone of contact with the component being ground, for the purpose of consequently applying pressure to the component in the grinding operation, wherein a first spacer (8), coaxially mountable on the drive shaft, is interposed between the disc-shaped bodies (5, 6), said first spacer (8) being provided with through-passages (10) extending radially through the first spacer (8), so as to form passages for conveying a cooling and/or lubricating liquid onto the surface of abrasive material of the grinding wheel, the grinding wheel further comprising a pair of second spacers (13), each of which is coaxially mountable on the drive shaft of the grinding wheel on a side opposite the first spacer (8), with respect to a corresponding disc-shaped body (5, 6), in such a manner that, as a result of the mounting operation, each disc-shaped body is interposed between the first spacer (8) and a corresponding particular second spacer (13).

2. The grinding wheel according to claim 1, wherein the disc-shaped bodies (5, 6) are made in the form of plates, the abrasive material arranged along the circumferential profile of the body extending from one of the opposing faces of the plate.

3. The grinding wheel according to claim 2, wherein the plates of the disc-shaped bodies (5, 6) are configured to be mounted coaxially on the drive shaft of the grinding wheel, respective surfaces (5*c*, 6*c*) carrying the abrasive material of each disc-shaped body (5, 6) being in mutually facing positions so as to define together a groove (7) of abrasive material which extends circumferentially along the outer profile of the disc-shaped bodies and which is adapted to move into contact with corners of the sheet-shaped component which is to be beveled by the grinding operation.

4. The grinding wheel according to claim 3, wherein the groove (7) having sides defined by the disc-shaped bodies (5, 6) has a V-shaped axial cross-section having a concavity facing the sheet-shaped component to be subjected to grinding, each side of the groove (7) being capable of contact with one of respective corners of the edge of the sheet-shaped component.

5. The grinding wheel according to claim 1, further comprising a pair of outer flanges (14) which are coaxially mountable on the drive shaft, each in a position abutting the respective second spacer (13), so as to form a means for limiting the resilient flexion of the respective disc-shaped body (5, 6) associated with it.

6. The grinding wheel according to claim 5, wherein the disc-shaped bodies (5, 6), the first spacer (8), the pair of second spacers (13) and the pair of outer flanges (14) are coaxially clamped together in the form of an assembly on a terminal shank of the drive shaft.

7. The grinding wheel according to claim 1, wherein each disc-shaped body (5, 6) has, in a circumferential position on a free end of each annular profile of the surface of abrasive material, a regular sequence of projections (18) alternating with recesses (19), together defining a front toothed profile (20), the toothed profiles of the disc-shaped bodies (5, 6) being capable of meshing with each other by the relative engagement of the recesses (19) and projections (18) with each other, so as to maintain a portion of the abrasive surface in the groove (7) at all times, even after the groove sides have moved apart as a result of the flexion of the disc-shaped bodies (5, 6).

8. The grinding wheel according to claim 2, wherein each of the plates forming the corresponding disc-shaped body (5, 6) is made of spring steel or other low-hysteresis material.

* * * * *